US009341011B2

(12) United States Patent
Haab et al.

(10) Patent No.: US 9,341,011 B2
(45) Date of Patent: May 17, 2016

(54) ADJUSTABLE MOUNTING DEVICE FOR A SLIDING ELEMENT AND SLIDING DEVICE

(71) Applicant: HAWA AG, Mettmenstetten (CH)

(72) Inventors: Gregor Haab, Allenwinden (CH); Peter Ettmüller, Jonen (CH); Myrta Kappeler, Muri (CH); Nejib Yezza, Rickenbach b. Schwyz (CH)

(73) Assignee: HAWA AG, Mettmenstetten (CH)

( * ) Notice: Subject to any disclaimer, the term of this patent is extended or adjusted under 35 U.S.C. 154(b) by 0 days.

(21) Appl. No.: 14/477,537

(22) Filed: Sep. 4, 2014

(65) Prior Publication Data

US 2015/0074942 A1 Mar. 19, 2015

(30) Foreign Application Priority Data

Sep. 18, 2013 (EP) ..... 13185056

(51) Int. Cl.
*E05D 15/06* (2006.01)

(52) U.S. Cl.
CPC ..... *E05D 15/0634* (2013.01); *E05D 15/06* (2013.01); *E05D 15/063* (2013.01); *E05D 15/0652* (2013.01); *E05Y 2201/638* (2013.01); *E05Y 2600/31* (2013.01); *E05Y 2600/312* (2013.01); *Y10T 16/3825* (2015.01); *Y10T 16/3834* (2015.01)

(58) Field of Classification Search
CPC . E05D 15/06; E05D 15/0621; E05D 15/0626; E05D 15/063; E05D 15/0634; E05D 15/0639; E05Y 2201/638; Y10T 16/381; Y10T 16/3825; Y10T 16/3834
See application file for complete search history.

(56) References Cited

U.S. PATENT DOCUMENTS

| | | | | | |
|---|---|---|---|---|---|
| 299,156 | A | * | 5/1884 | Moore | E05D 15/0634 16/105 |
| 418,638 | A | * | 12/1889 | Barry | E05D 15/0634 16/105 |
| 423,952 | A | * | 3/1890 | Prindle | E05D 15/0634 16/105 |
| 524,609 | A | * | 8/1894 | Prouty | E05D 15/0634 16/105 |
| 844,468 | A | * | 2/1907 | Prouty | E05D 15/063 16/105 |
| 956,025 | A | * | 4/1910 | Ballard | E05D 15/0634 16/105 |
| 1,042,927 | A | * | 10/1912 | King | E05D 15/0634 16/105 |

(Continued)

FOREIGN PATENT DOCUMENTS

| | | |
|---|---|---|
| DE | 33 38 146 A1 | 7/1984 |
| EP | 0 818 598 A1 | 1/1998 |

(Continued)

*Primary Examiner* — Jeffrey O Brien
(74) *Attorney, Agent, or Firm* — Oliff PLC

(57) ABSTRACT

Mounting device includes a connecting bolt, plate-shaped sliding element connectable to a carriage held displaceable in a running rail. Mounting device includes holding rail, mountable in recess at upper side of the sliding element, and holding device held releasably in the holding rail, includes bearing device, adjustment screw is rotatably held, adjustment screw includes a screw shaft, aligned along screw axis, engages in threaded member of track body, movable along screw axis and includes two track walls aligned parallel to one another and include each a track element, which guide elements are engaged that are connected to connecting bolt, held in guide member displaceable along guide axis. Track sledge is equipped on opposite sides with guide elements engaged in track element of track body and connecting bolt includes first connecting part held in track sledge, second connecting part held in guide member and third connecting part connectable to carriage.

14 Claims, 12 Drawing Sheets

(56) References Cited

Figures 1A, 1B:
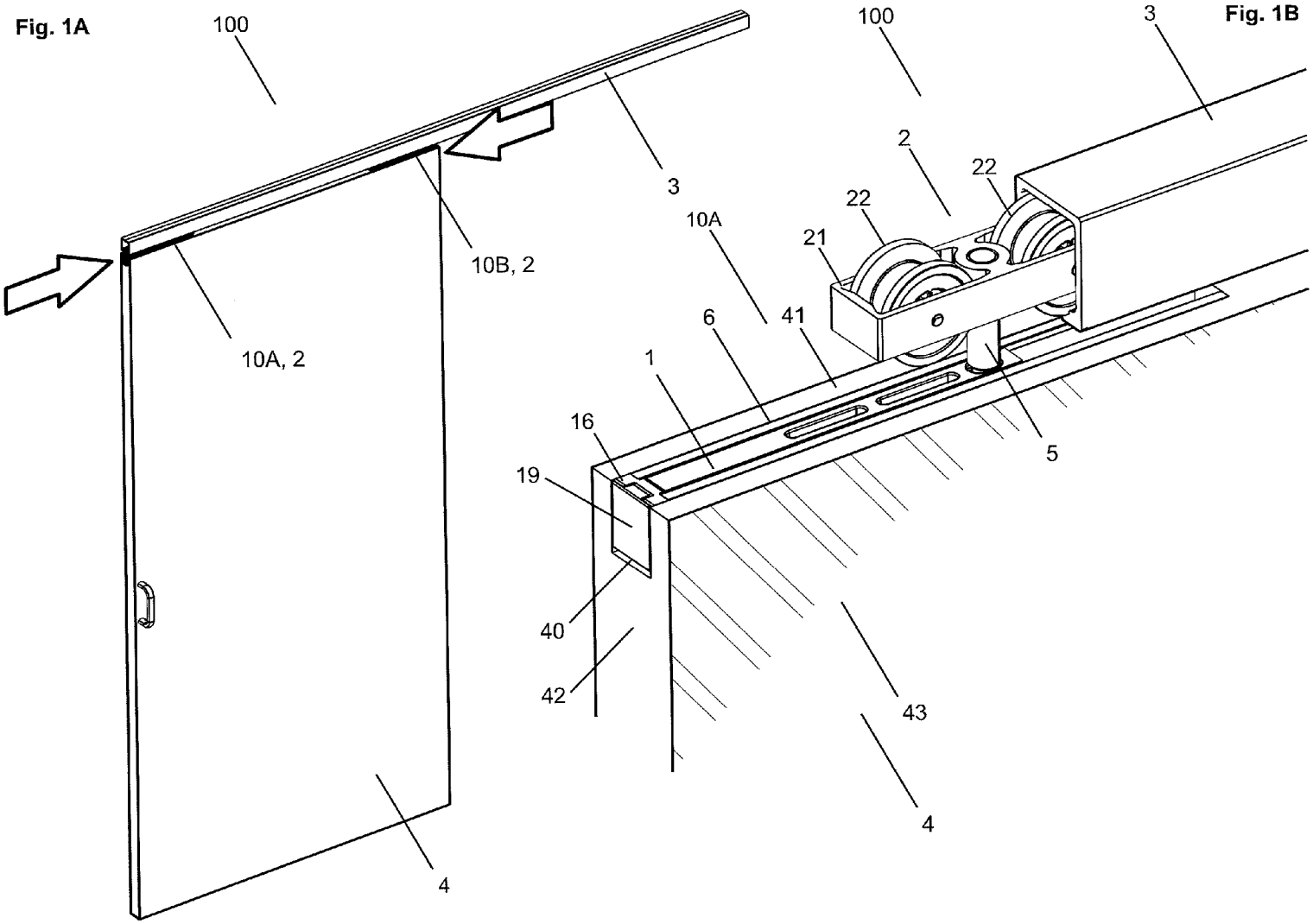

U.S. PATENT DOCUMENTS 1,075,089 A * 10/1913 Chamberlin et al. ..... E05D 15/0643 16/105
2,482,856 A * 9/1949 Lloyd ..... E05D 15/063 16/89
3,298,136 A * 1/1967 Saunders ..... E05D 15/0669 16/105
3,299,575 A * 1/1967 Du Shane ..... E05D 15/0669 16/97
3,517,409 A * 6/1970 Edeus ..... E05D 15/0634 16/105
3,555,612 A * 1/1971 Procton ..... E05D 15/0634 16/105
4,014,073 A * 3/1977 Uehara ..... E05D 15/0669 16/105
5,018,306 A * 5/1991 Prevot ..... E05D 15/06 49/425
8,522,398 B2 * 9/2013 Haab ..... E05D 15/0634 16/102
2005/0235571 A1 * 10/2005 Ewing ..... E05C 7/06 49/410
2008/0092330 A1 * 4/2008 Haab ..... E05D 15/0634 16/98
2009/0100760 A1 * 4/2009 Ewing ..... E05B 65/0876 49/410
2010/0031577 A1 * 2/2010 Haab ..... E05D 15/0652 49/449
2010/0270898 A1 * 10/2010 Haab ..... E05D 15/0634 312/323
2013/0111702 A1 * 5/2013 Ewing ..... E05D 15/0634 16/91
2015/0211275 A1 * 7/2015 Terno ..... E05D 15/0652 16/93 R

FOREIGN PATENT DOCUMENTS

WO WO 97/38198 A1 10/1997
WO WO 2004/040091 A1 5/2004
WO WO 2011/063535 A1 6/2011
WO WO 2011/161707 A1 12/2011

* cited by examiner 3
100
2
22
22
21
41
10A
6
1
16
19
40
42
43
4
5
3
10B, 2
10A, 2
100
4

ADJUSTABLE MOUNTING DEVICE FOR A SLIDING ELEMENT AND SLIDING DEVICE

The invention relates to an adjustable mounting device for a sliding element, particularly a sliding door that is held by two carriages that are slidably held in a running rail and to a sliding device with such mounting devices.

A mounting device for this purpose is known from [1], EP0818598A1. This mounting device comprises a holding rail that is connectable to the sliding door and that serves for receiving a holding device, which is connectable via a connecting screw with a carriage. The holding rail is inserted into a recess, which is provided on one end on the upper side of the sliding door. The holding device comprises a holding block that is held in the holding rail in a form-locking manner, that is axially movable within the holding rail, and that can be fixed at a desired position by means of a the edge. This fixing position is selected in such a way, that the carriage reaches at a location a buffer device provided in the running rail, at which location the sliding door exhibits a desired distance to the door frame. However, if the holding block is not fixed at this position, then the sliding door reaches the door frame before the carriage has reached the buffer device or is being held in a larger distance therefrom, so that an undesirable gap between the door frame and the sliding door remains open.

Within the holding block the head of the connecting screw is rotatably held and can be fixed by means of a fixing screw. In order to align the upper edge of the sliding door horizontally and to adjust the connecting screw accordingly, the holding block is moved out of the holding rail until the fixing screw can be released and the connecting screw can be grasped with a tool and can be turned. After the adjustment of the connecting screw, the holding block is shifted again into the holding rail and is fixed at the predetermined position, in order to obtain the desired distance between the sliding door and the door frame. Hence, the process of precisely adjusting the mounting device requires time and skills.

[2], WO2011063535A1, discloses a mounting device with a holding rail that serves for receiving a holding device that is connected via connecting screw to a carriage. In this case, the connecting screw can only be adjusted, when the holding device has been taken out of the holding rail.

[3], WO2011161707A1, discloses a mounting device with connecting screws with screw heads that are traversed by an adjusting screw. By turning the adjusting screw the connecting screws are guided along a wedge and thus displaced horizontally and vertically. Consequently after the height adjustment, the end position of the sliding door requires readjustment.

[4], WO9738198A1, and [5], DE3338146A1, disclose further mounting devices, which require readjustment of the end position of the sliding door after height adjustment has been performed.

[6], WO2004040091A1, discloses a mounting device with a connecting bolt which connects a sliding door with a carriage that is held in the running rail. The connecting bolt, which is held vertically displaceable in a guide member, is provided with a horizontally aligned cross bolt, which is held in tracks of a track body. The track body can be moved horizontally, causing a vertical displacement of the cross bolt and the connecting bolt.

In this mounting device the device parts are exposed to severe load and stress, wherefore after a longer period of operation abrasive wear and deformation of continuously contacted parts can occur.

The cross bolt needs to have a small diameter so that it can be guided through the connecting bolt. Hence, with the occurrence of a high load e.g. after the installation of a heavy sliding door the relatively thin cross bolt can get bent. Further the cross bolt is supported by a minimal bearing area with a correspondingly high support pressure, wherefore the guide tracks can get deformed. After such damages have occurred smooth adjustment of the device is no longer possible. Further, the connecting bolt can get disengaged from the track body, when it is turned.

It is important to note, that not only the whole load of the sliding door acts on the thin cross bolt, but also even higher forces, e.g. when the sliding door hits an obstacle such as a rail buffer, which forces would lead to the destruction of the mounting device if it is not designed stable enough.

Disadvantageous is further that the connecting bolt can only be displaced over a short vertical distance, wherefore a small adjusting range results.

Since the cross bolt is held within the track body, the cross bolt can only be turned together with the complete holding device. Since running rails are typically mounted close to a building wall, which inhibits turning of the holding device, a connection of the holding device to a carriage is only possible, if the carriage is taken out of the running rail. However, in the event that the carriage is firmly enclosed in the running rail mounting is not possible.

Hence, the present invention is based on the object of providing an improved mounting device that can be connected to a sliding element and via an adjustable connecting bolt to a carriage that is guided in a running rail. Further an improved sliding element equipped with at least one inventive mounting device shall be created.

The mounting device shall be suitable for installing heavy sliding doors and shall be operable without wear, particularly deformations. Smooth adjustments of the mounting device shall be possible even after longer periods of operation.

Thereby, the connecting bolt shall be adjustable without moving the holding device out of the holding rail.

Further, the mounting device shall be adjustable in such a way, that the connecting bolt is moved axially only and an adjustment of external device parts, such as external buffer devices is not required.

In a further preferred embodiment the mounting device shall be designed in such a way, that an external buffer device is not required.

This object is reached with a mounting device and a sliding door that comprise the features of claims 1 or 15 respectively.

The mounting device comprises a connecting bolt, with which a plate-shaped sliding element is connectable to a carriage that is held displaceable in a running rail. The mounting device comprises a holding rail, which is mountable in a recess provided at the upper side of the sliding element, and a holding device that is held releasably in the holding rail and that comprises a bearing device, in which an adjustment screw is rotatably held, which adjustment screw comprises a screw shaft that, aligned along a screw axis, engages in a threaded member of a track body, which is movable along the screw axis and which comprises two track walls that are aligned in parallel to one another and that comprise each a track element, in which guide elements are engaged that are connected to the connecting bolt, which is held in a guide member displaceable along a guide axis.

According to the invention a track sledge is provided that is equipped on opposite sides with the guide elements that are engaged, preferably in a form-locking manner, in the track element of the track body and wherein the connecting bolt comprises a first connecting part that is held in the track sledge, a second connecting part that is held in the guide member and a third connecting part that is connectable to the carriage.

The use of the track sledge allows a stable connection of the connecting bolt to the track body.

The guide elements extend preferably along a section of the track elements, so that the guide elements and the track elements abut in a plane on one another.

In this manner, a relatively small support pressure results even then, when heavy sliding doors are suspended on the mounting devices. Deformations of device elements, which could disturb adjustment procedures, are avoided. Furthermore, due to the small support pressure adjustment procedures can be executed with little force applied.

The use of a track sledge allows advantageous mounting of the connecting bolt, which can be mounted in movable or rotatable around the guide axis.

The connecting bolt can advantageously be turned into a carriage body without the requirement of turning the whole mounting device. The mounting device can therefore be connected to carriages that are enclosed in a running rail that is mounted close to a building wall.

Furthermore, the track sledge can easily be inserted into the track body and is held stable therein.

In a preferred embodiment, the guide elements are held by the track elements on both sides, so that the guide elements cannot get decoupled from the track elements and cannot get turned. Hence, the track sledge can only move linearly forth and back in a specific alignment. E.g., wing-shaped guide elements engage in groove-shaped track slots. Hence, the track sledge is linearly guided and held and can even under the impact of force, e.g. when the sliding door hits an obstacle, not leave its track.

The holding rail is normally mounted at one end on the upper side of the sliding element and preferably is arranged within a recess. This recess can particularly easy be provided in a sliding element that is made of wood. If, e.g. when using a glass door, no recess is provided, then the holding rail is placed on the upper side of the sliding door, e.g. the glass plate, and is connected there with by means of known connecting elements. E.g., an opening is provided in the sliding door, through which a holding bolt is guided, that is held by flange elements that are connected to the holding rail.

The sliding device preferably comprises two mounting devices, which are mounted at opposite ends on the upper side of the sliding element or the sliding door and which are connected to carriages that are guided in the running rail. With the mounting devices the height of the sliding door can selectively be adjusted at both ends, so that the sliding door can be lifted to a desired height and can be aligned horizontally. I.e., with the two mounting devices, which are preferably mounted in recesses provided at the opposite ends on the upper side of the sliding door, the sliding door can be lifted to a desired height. Subsequently it is examined, whether the upper side of the sliding door is horizontally aligned. Remaining deviations can be corrected with a final adjustment of the one or other mounting device.

The adjustment of the mounting device is done by actuating the adjustment screw, whose head is facing the front side of the sliding door and can be grasped with a tool, without removing the holding device from the holding rail. Hence the adjustment can conveniently and precisely be executed with little effort.

By turning the adjustment screw the track body is moved along the screw axis, whereby the track sledge is shifted vertically thereto along the track elements. The track sledge is held by the connecting bolt, which is held by the guide member and can therefore be shifted along the guide axis always perpendicularly to the screw axis. During the movement of the track body with the track elements relative to the track sledge, the track sledge is lifted or lowered, i.e. vertically shifted along the guide axis.

During the adjustment of the connecting bolt the distance between the upper edge of the sliding element and the running rail changes. However, a shift of the sliding door or of the carriage in running direction relative to the running rail is avoided. Hence, the distance from the sliding door after reaching the end stop to the lateral door frame remains unchanged after the adjustment of the connecting bolt.

The bearing device comprises a holding arm, which is provided with at least one holding element that can interact in a form-locking manner with at least one fixing element, which is provided on the holding rail.

The holding rail preferably exhibits a U-profile with a centerpiece and sidewalls connected thereto. On the inner sides of the sidewalls, shaped elements are provided that are facing one another and that are extending in parallel to the longitudinal axis of the holding rail. The holding device is inserted along the shaped elements into the holding rail, which is open on the upper side, and is fixed at a position where the holding element can engage into the fixing element.

In a preferred embodiment a plurality of holding elements and/or a plurality of fixing elements are provided, which engage into one another according to the displacement of the holding device within the holding rail. The holding elements and the fixing elements preferably act as catch elements that correspond to one another.

In preferred embodiments, the fixing elements are provided as catch openings, catch edges or catch recesses on the inner side of the centerpiece of the holding rail. E.g., a group of von catch edges may be provided which exhibit catch planes, into which complementary holding elements can be engaged at selected positions. The holding elements are accordingly designed catch elements, such as cams, catch edges or catch planes.

The holding arm is bendable, so that the at least one holding element can be released from the fixing element by impact of force onto the holding arm. Hence, the holding device can be inserted into the holding device and is automatically fixed at the predetermined position or is moved to a desired position, at which the holding elements engage into the fixing elements.

By bending the holding arm can be released. This can be done easily with a functional cover that is pivotally connected to the bearing device and that comprises a functional lever, which is rotatable against the holding arm when the functional cover is opened, so that holding arm is releasably from the holding rail under impact of force. Hence, the holding device can be released with a grip of the hand and can be removed from the holding rail.

In a preferred embodiment the bearing device comprises a mounting flange, which overlaps the related front side of the holding rail at the entrance of the recess and which is connected firmly or resiliently with the connecting bolt. Hence, as soon as the carriage hits an obstacle the kinetic energy of the sliding element can be transferred via the holding rail and the mounting flange to the connecting bolt and therefore to the carriage and a the rail buffer.

With the functional cover, which can be rotated e.g. by 90°, on the one hand a tool channel can be opened, through which a tool can be guided towards the adjustment screw. On the other hand with the preferably designed functional cover the holding arm can be actuated. In a preferred embodiment, the functional cover is slightly pre-tensioned by the holding arm via the integrated functional lever, so that the functional cover sits in closed position always tight at the mounting flange.

The head of the adjustment screw is held axially immovable in the bearing device and is facing the functional cover, which after opening provides access to the head the adjustment screw. After opening the functional cover the engineer can access the adjustment screw and can turn it with a tool as required.

The bearing device preferably comprises a guide arm, which holds the guide member, through which the connecting bolt can be moved is.

In a preferred embodiment, the holding arm and/or the guide arm are designed elastically or telescopically or resiliently held, so that they are extendable under impact of force. Hence, forces, which are received via the guide arm, when the sliding door hits an end stop, can be compensated by the holding arm or elastic elements connected thereto.

By this measure the function of an external buffer device can be integrated into the inventive mounting device. However, in the running rail a simple end stop can be provided.

The bearing device can be designed in one piece or can comprise a first bearing member provided with the holding arm preferably made from public plastic and a second bearing member with the guide arm preferably made from metal.

The design of the bearing device in two parts advantageously allows implementing the functions of the bearing device. In the first bearing member made of plastic the elastic holding arm and elastic catch elements can be implemented, which interact with the second bearing member.

The second bearing member made from metal can advantageously be provided with the guide member, which serves for the stable seating and holding of the connecting bolt. Further, the second bearing member can advantageously be provided with stable, shaped elements, such as a mounting shoulder, with which the holding device can be held in a form-locking manner within the holding device.

The two bearing members can advantageously be connected in a form-locking manner with elastic catch elements, which are provided at the first bearing member and which can engage in thereto complementary catch elements provided at the second bearing member.

Figures 2A, 2B:
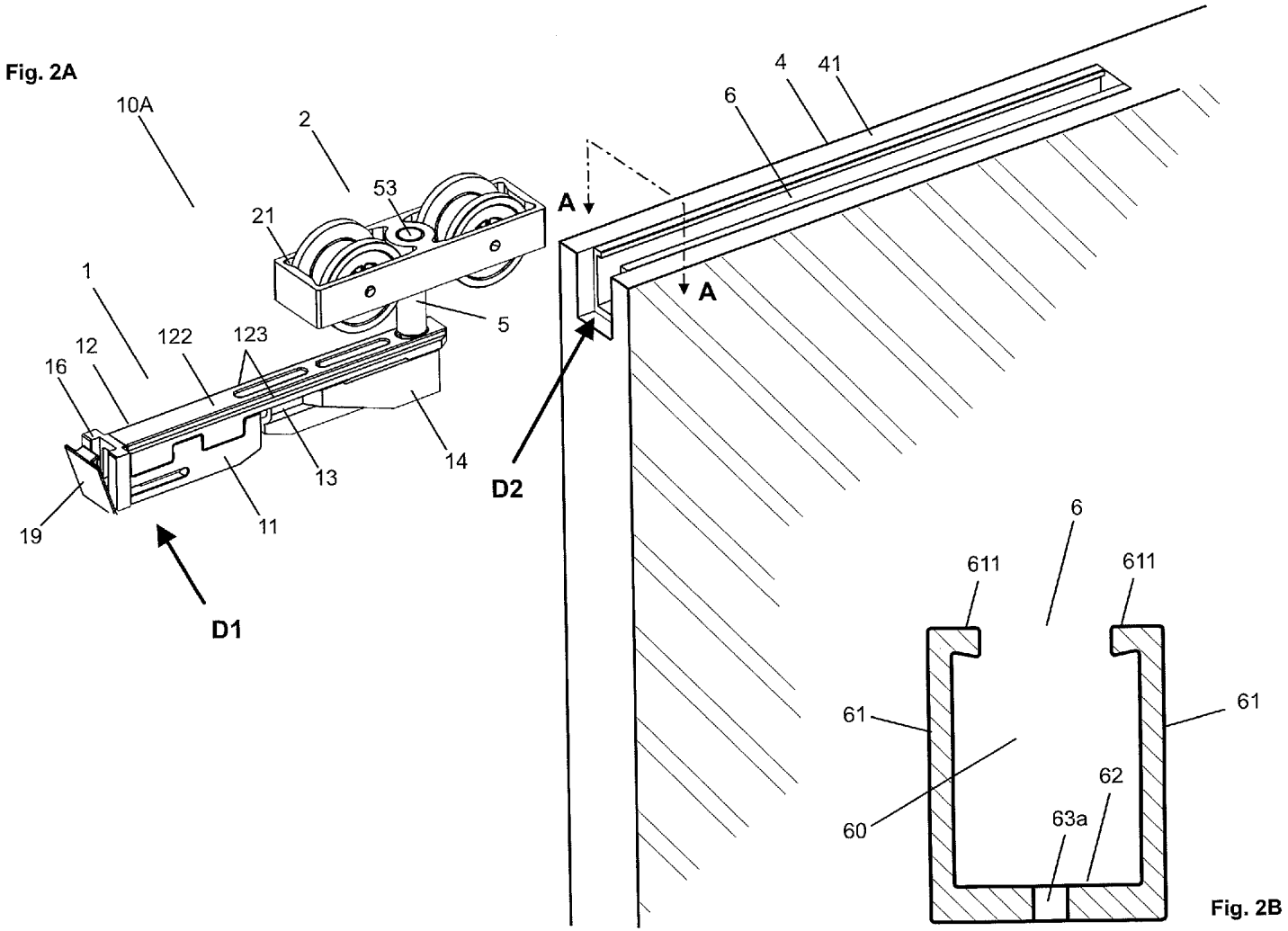
Figure 2D:
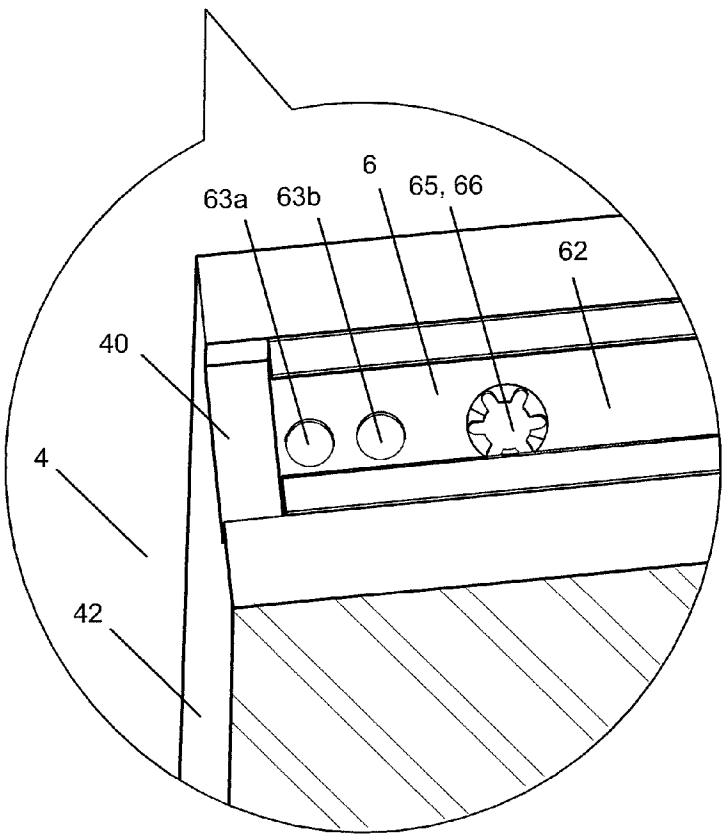
Figure 2C:
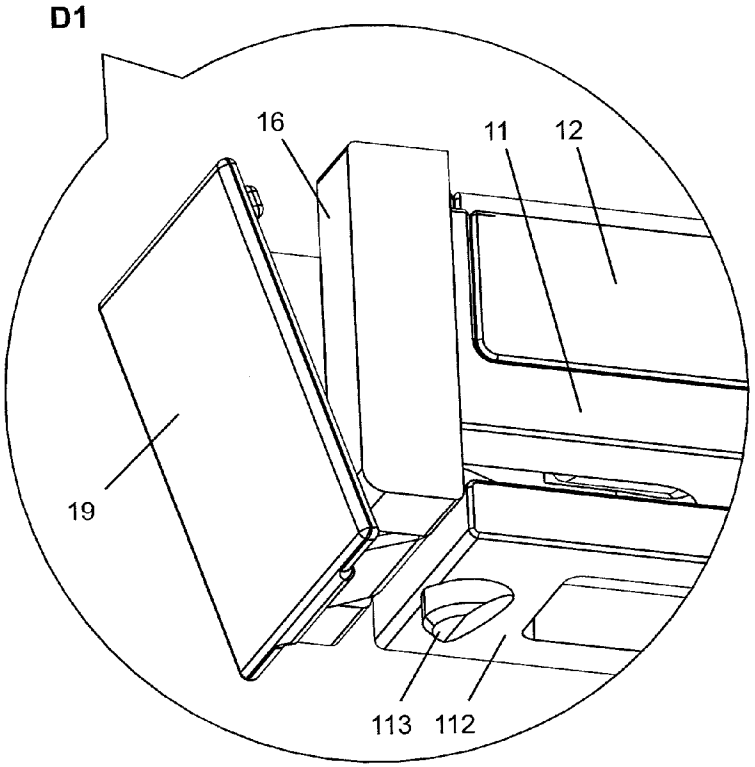
Figure 3A:
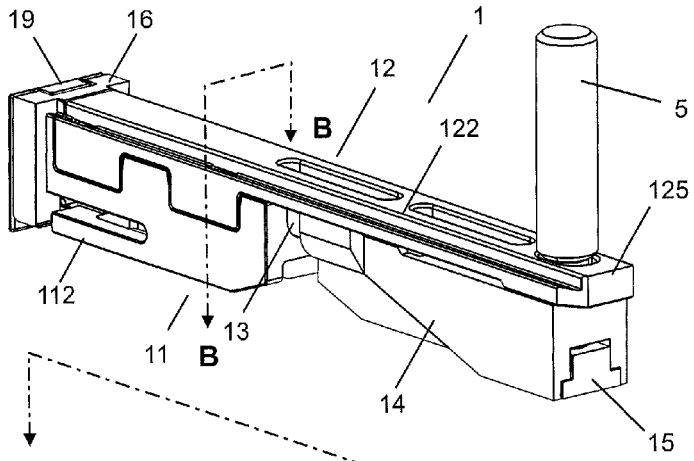
Figure 3B:
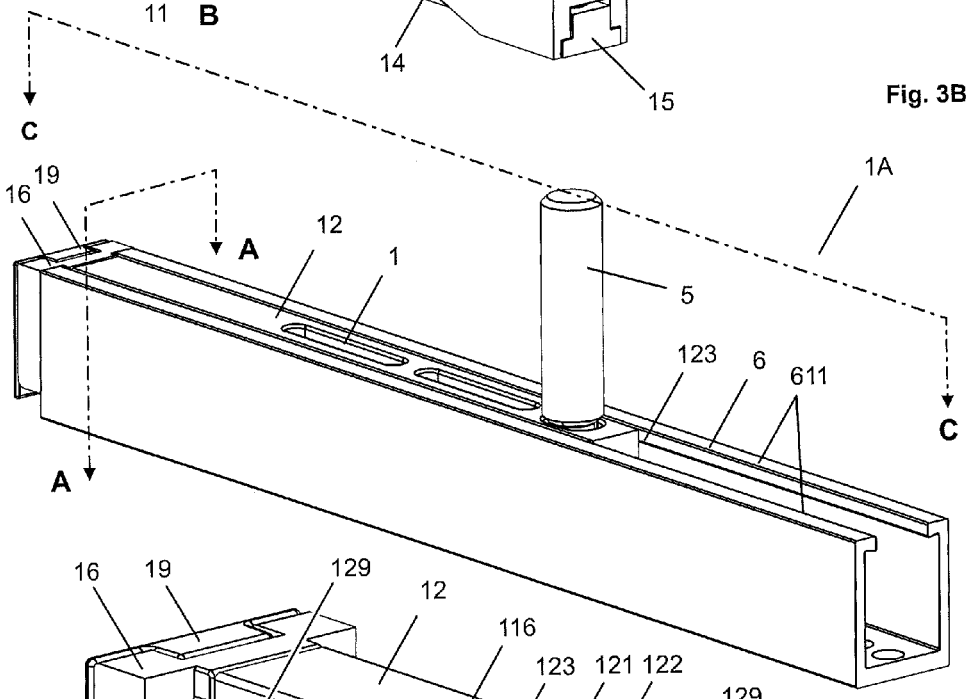
Figure 3C:
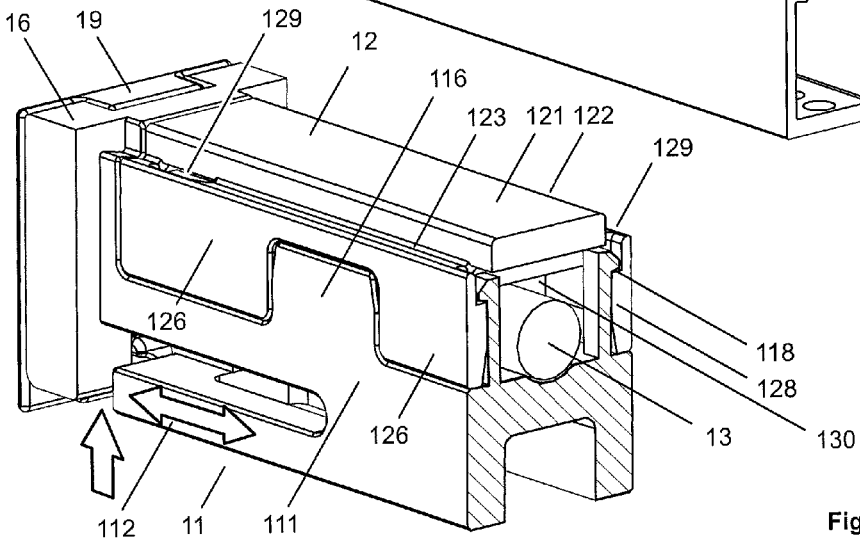
Figure 4:
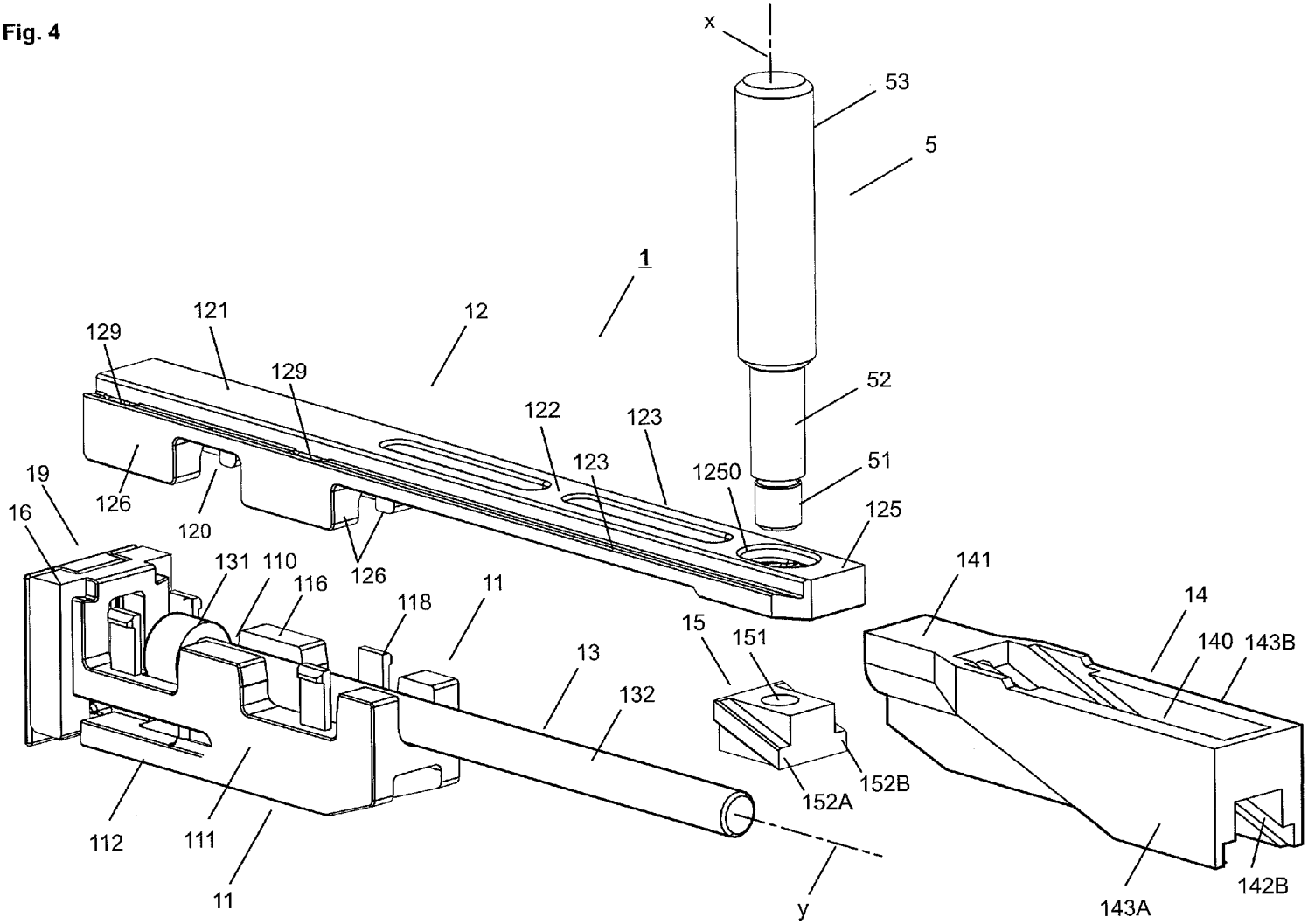
Figure 5A:
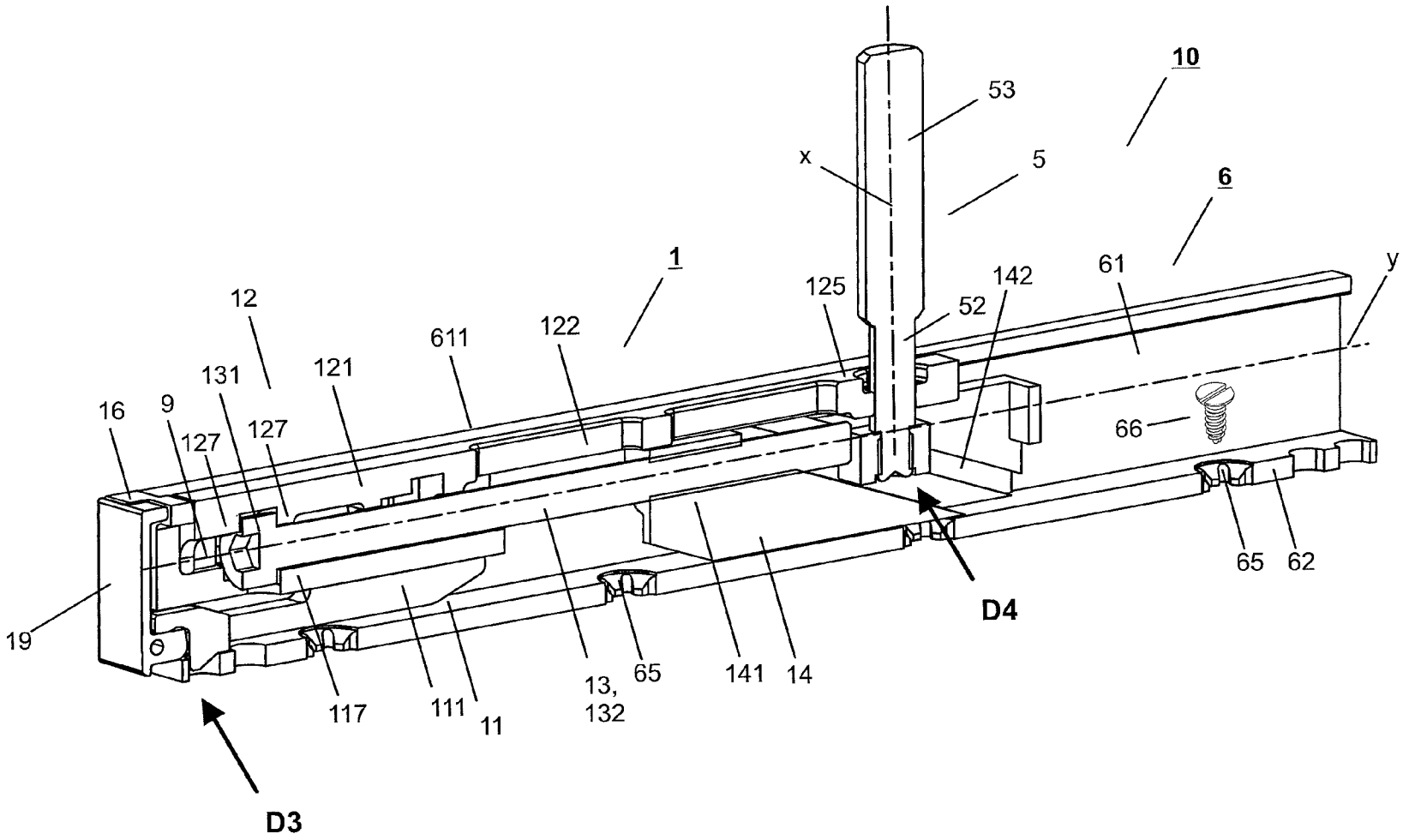
Figure 5C:
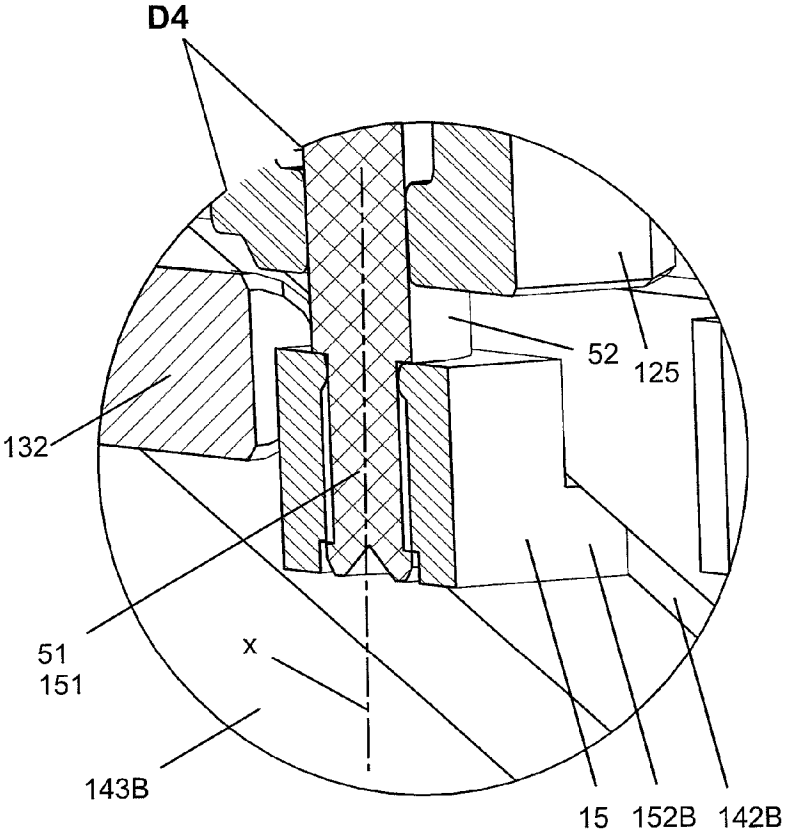
Figure 5B:
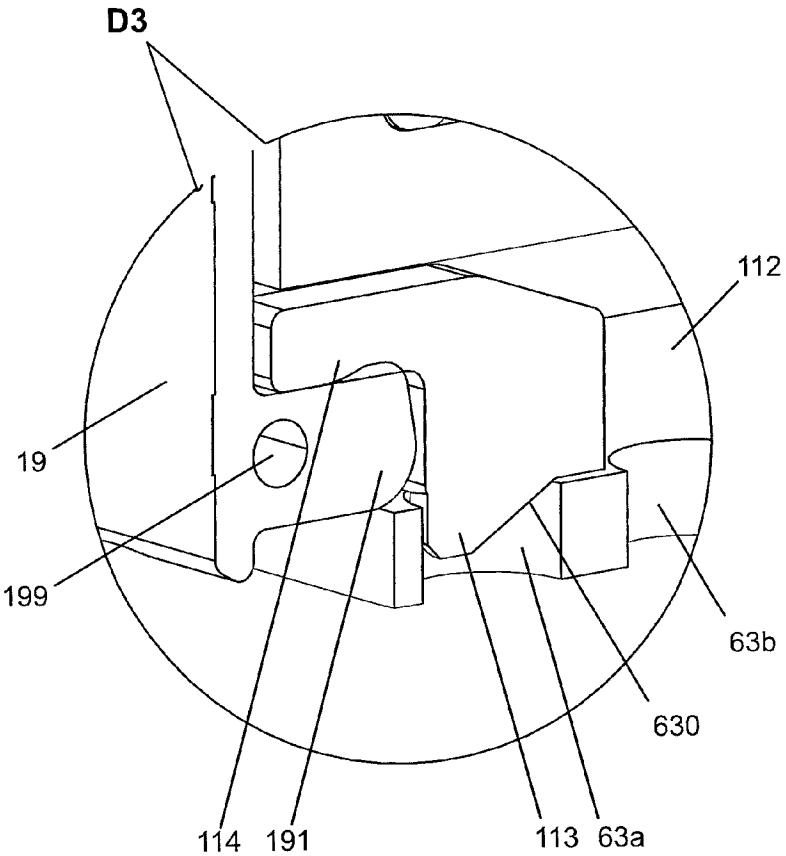
Figures 6A, 6B:
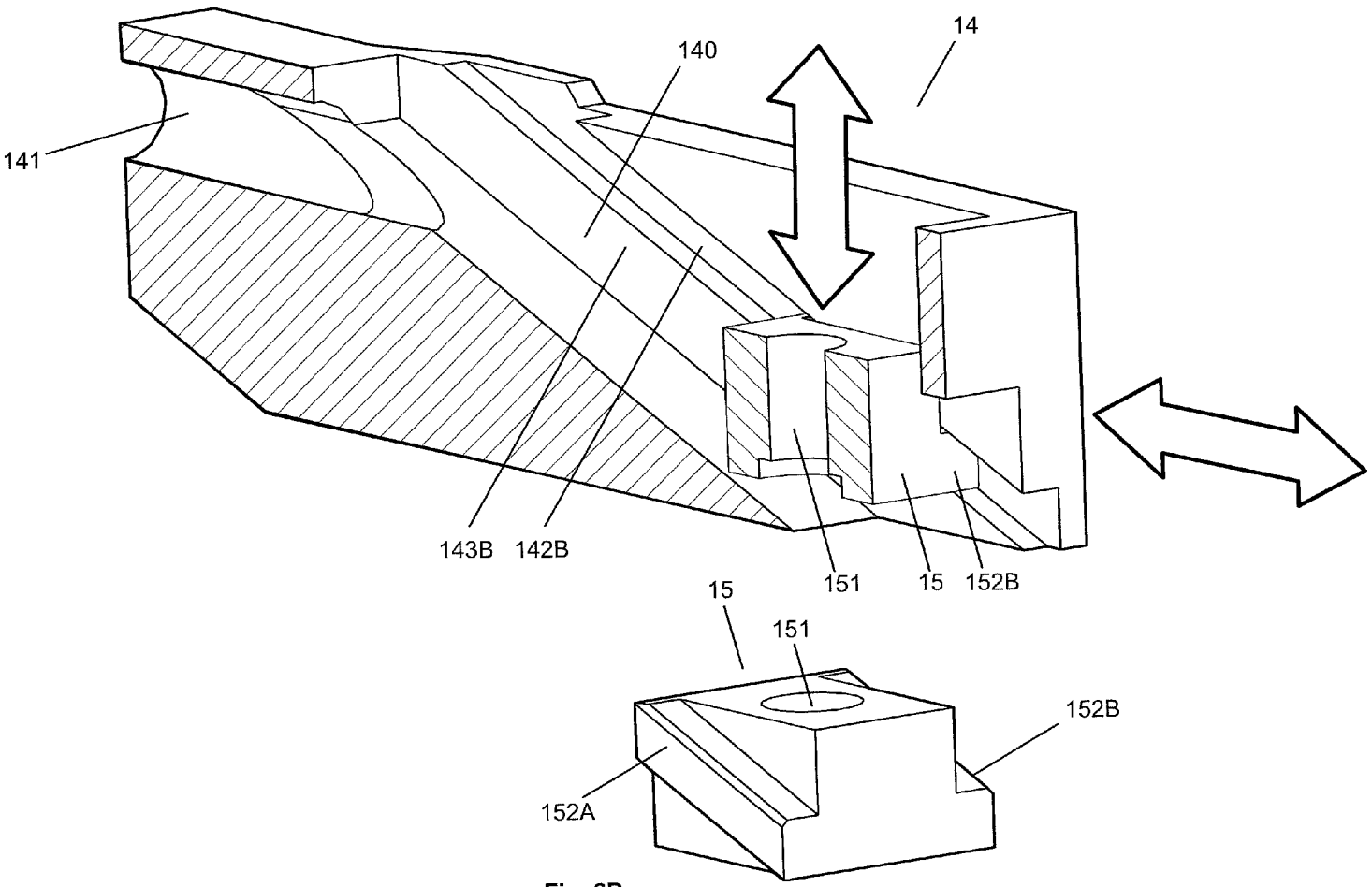
Figure 7A:
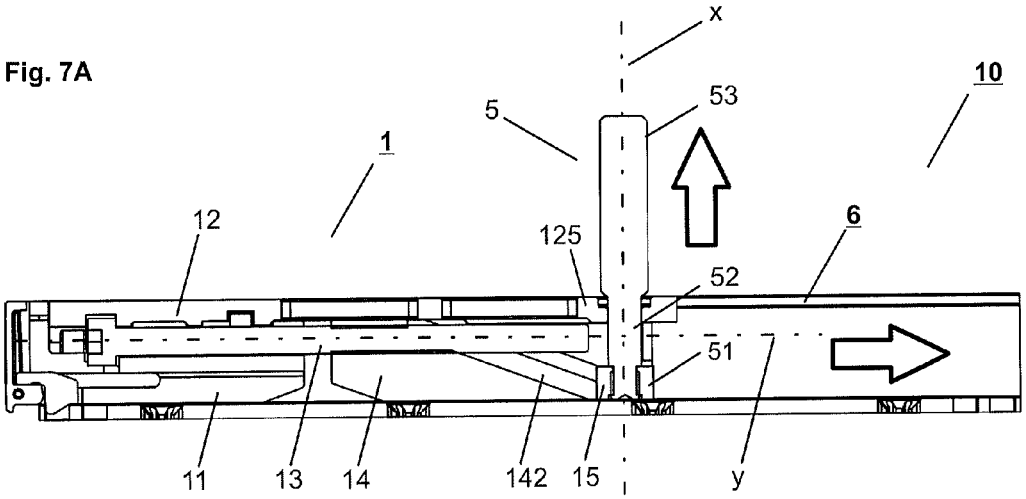
Figure 7B:
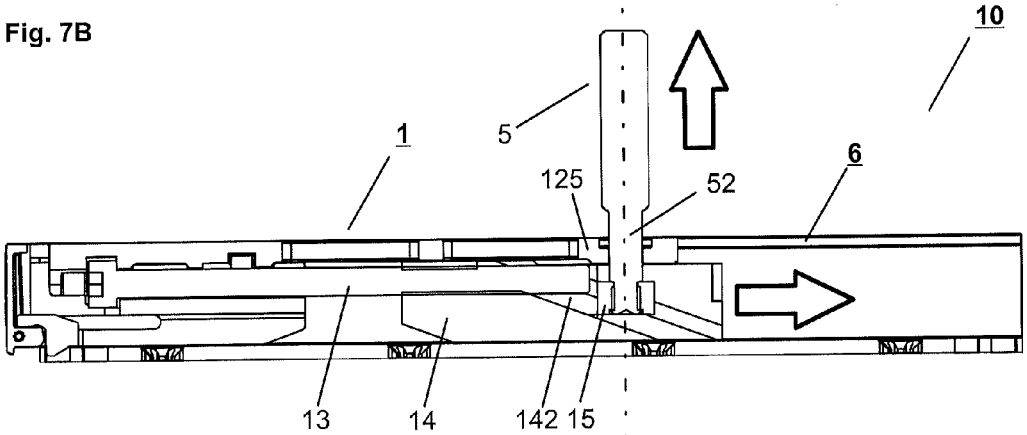
Figure 7C:
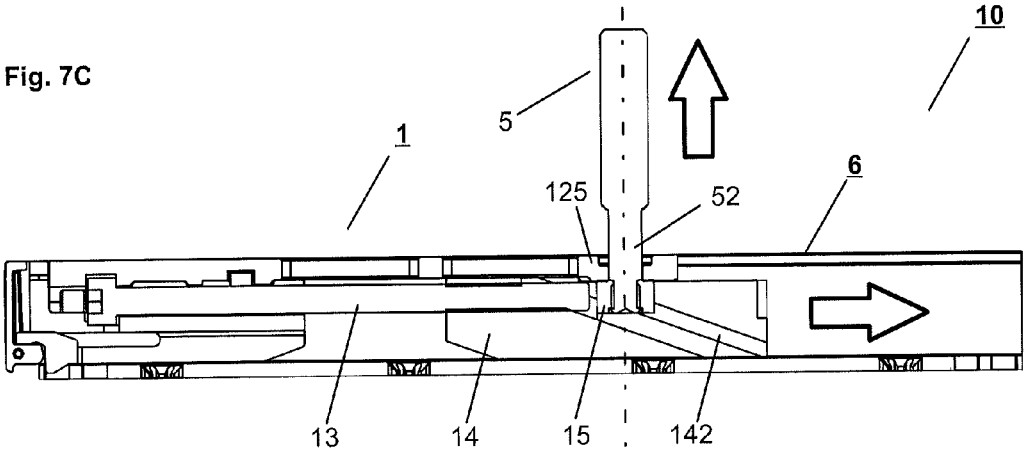
Figure 8A:
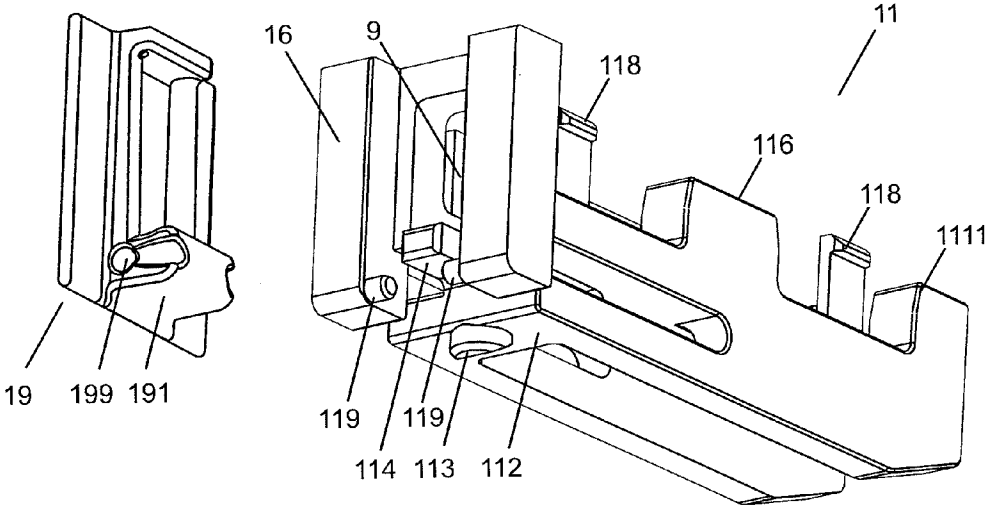
Figure 8B:
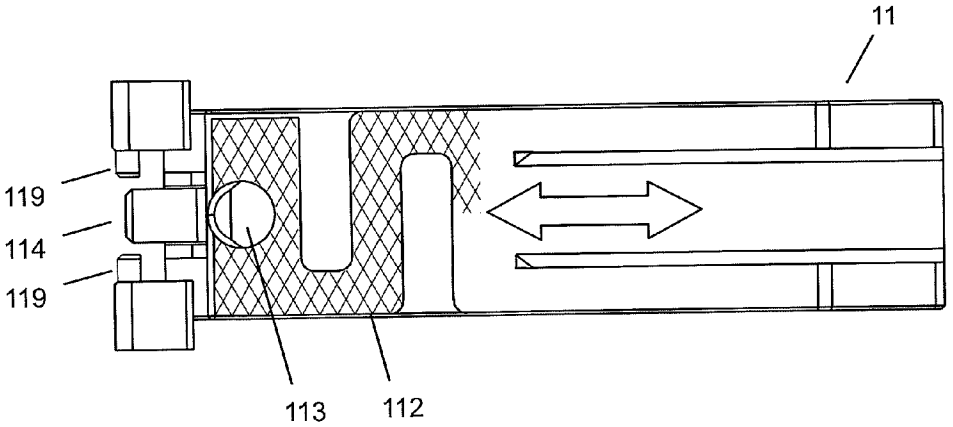
Figure 9:
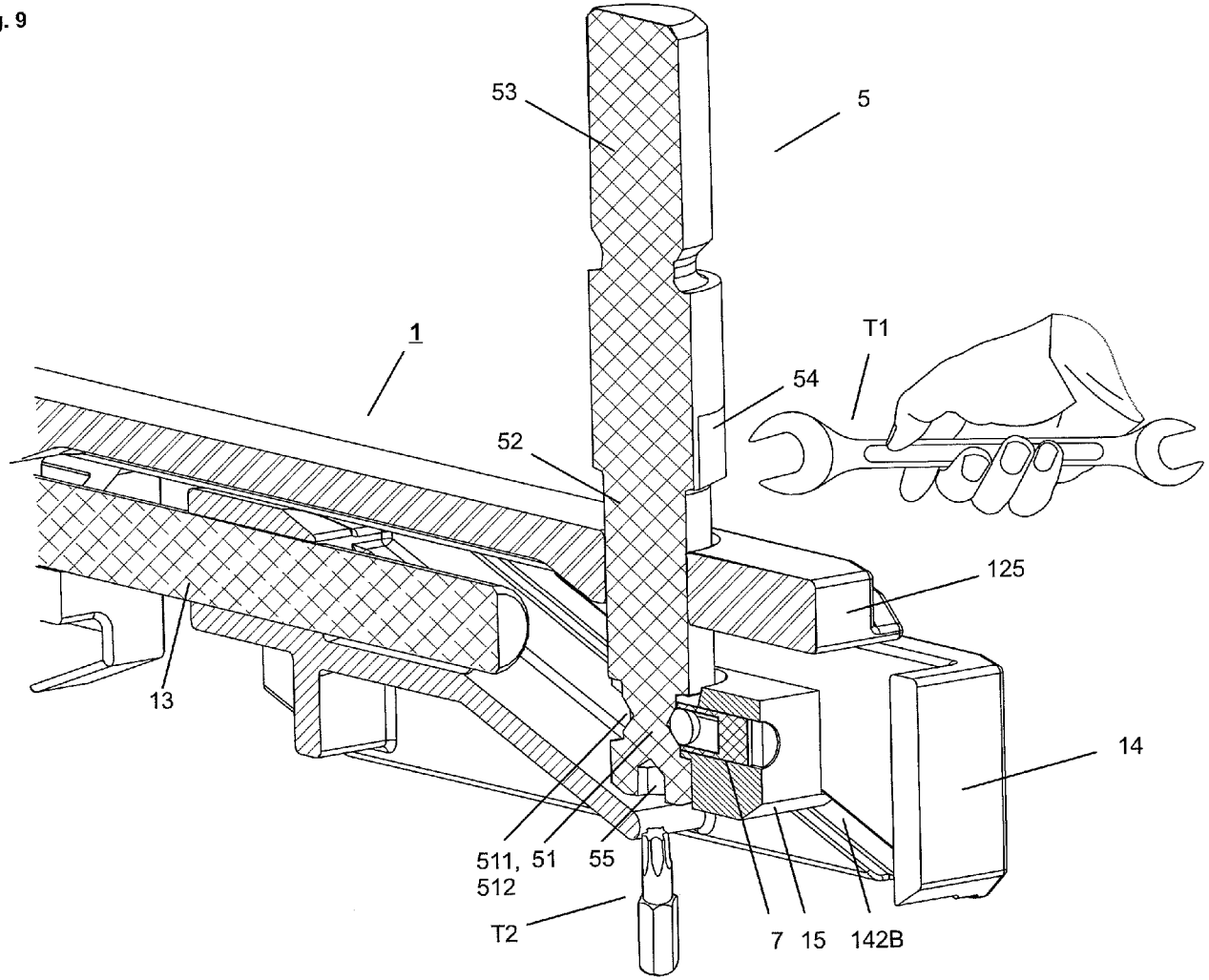
Figure 10C:
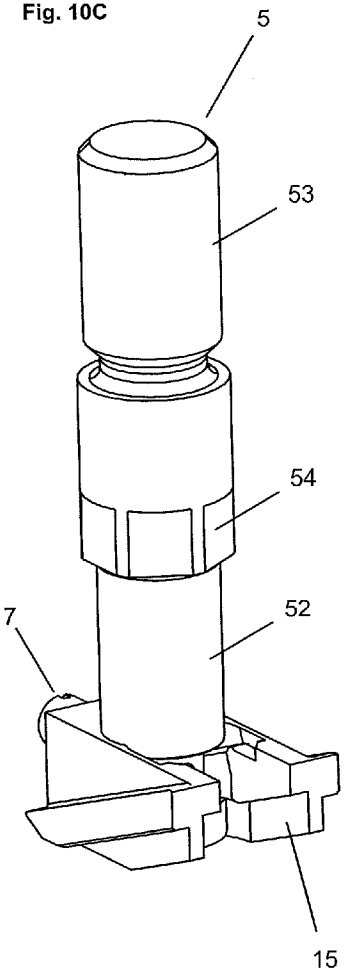
Figure 10B:
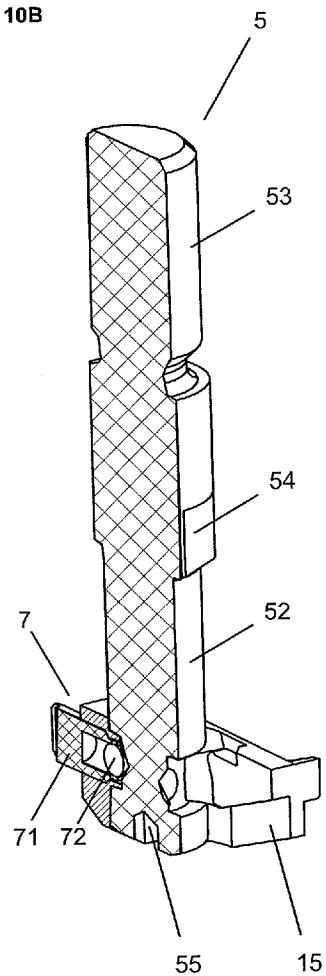
Figure 10A:
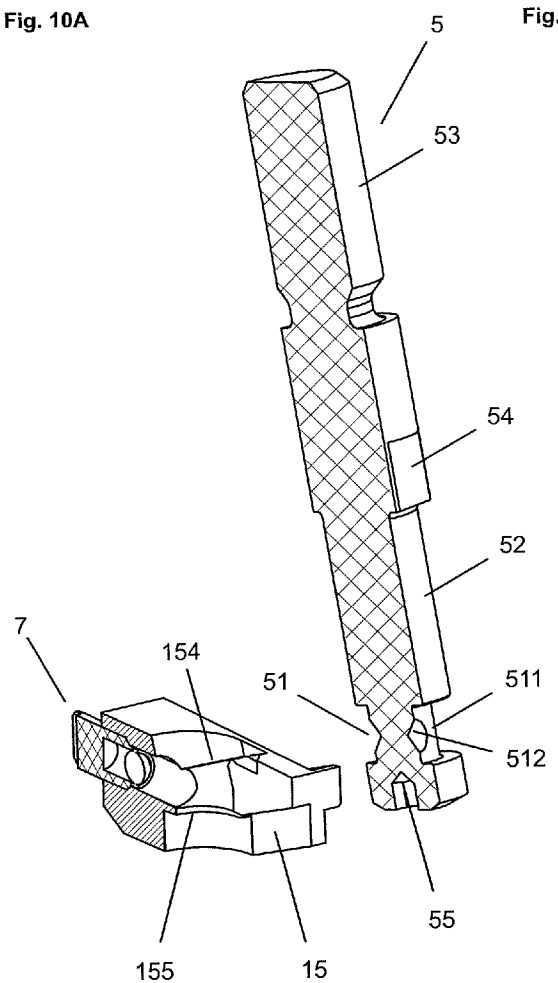

Below the invention is described in detail with reference to the drawings. Thereby show:

FIG. 1A an inventive sliding device 100 with a sliding door 4, that is connected via a first and a second inventive mounting device 10A; 10B to related carriages 2, that are slidably held in a running rail 3;

FIG. 1B a part of the sliding device 100 of FIG. 1 with the first mounting device 10A, which comprises a holding rail 6 arranged in a recess 40 at the upper side 41 of the sliding door 4 and, held in the holding rail 6, a holding device 1 that is connected via a connecting bolt 5 with a carriage 2 that is guided in a running rail 3, which has been retracted in order to show the carriage 2;

FIG. 2A the first mounting device 10A with the holding device 1, which is being inserted or has been taken out of the holding rail 6 as well as detailed views of the front side of the holding device 1 and of the front sided end piece of the holding rail 6, in which two fixing elements 63*a*, 63*b* are provided;

FIG. 2B the holding rail 6 cut in the range of the fixing elements 63*a* along line A-A shown FIG. 2A and FIG. 3B;

FIG. 2C a detailed view D1 of the front side of the holding device 1 of FIG. 2A;

FIG. 2D a detailed view D2 of the front end of the holding rail 6 of FIG. 2A, in which two fixing elements 63*a*, 63*b* are provided;

FIG. 3A the holding device 1 of FIG. 2B;

FIG. 3B the mounting device 10A of FIG. 2B with the holding device 1 inserted into the holding rail 6;

FIG. 3C the holding device 1 of FIG. 3A cut along line B-B shown in FIG. 3A;

FIG. 4 the holding device 1 of FIG. 3A in exploded view with a bearing device consisting of a first bearing member 11 and a second bearing member 12, in which an adjustment screw 13 is rotatably held, with which a track body 14 having track elements 142 is axially movable, along which track elements 142 a track sledge 15 is slidable that is connected to the connecting bolt 5;

FIG. 5A the mounting device 10 of FIG. 3B cut along cutting line C-C;

FIG. 5B a detailed view D3, which shows the coupling of the holding device 1 of FIG. 5A to the holding rail 6;

FIG. 5C a detailed view D4, which shows the track sledge 15 of FIG. 5A guided in the track slot 142;

FIG. 6A a sectional view of the track sledge 15 of FIG. 5A that is slidably held in the track body 14;

FIG. 6B the complete track sledge 15 of FIG. 6A, which comprises a receiving opening 151 for the connecting bolt 5 and on opposite sides each a first and second guide element 152A; 152B;

FIG. 7A the mounting device 10 in the sectional view of FIG. 5A with the connecting bolt 5 completely moved downwards;

FIG. 7B the mounting device 10 in the sectional view of FIG. 5A with the connecting bolt 5 at medium height;

FIG. 7C the mounting device 10 in the sectional view of FIG. 5A with the connecting bolt 5 completely moved upwards;

FIG. 8A the first bearing member 11 of FIG. 4 seen from the backside as well as the functional cover 19 separated therefrom;

FIG. 8B the first bearing member 11 of FIG. 8A in a preferred embodiment provided with a bendable and extendable holding arm 112;

FIG. 9 the rear end of the holding device 1 of FIG. 5A with the connecting bolt 5 in a preferred embodiment, which is held rotatable in a preferred embodiment of the track sledge 15 and which is adjustable stepwise by means of a first or a second tool T1, T2;

FIG. 10A a sectional view of the connecting bolt 5 and the fork-shaped track sledge 15 of FIG. 9 during installation;

FIG. 10B a sectional view of the connecting bolt 5 and the fork-shaped track sledge 15 of FIG. 10A after installation, after which a spring-loaded ball 72 of a coupling element 7 engages in a holding seat 512 of the connecting bolt 5; and FIG. 10C the connecting bolt 5 and the fork-shaped track sledge 15 of FIG. 10B incomplete view.

FIG. 1A shows an inventive sliding device 100 with a running rail 3, in which two carriages 2 are guided that are connected via a first and a second inventive mounting device 10A; 10B to a sliding door 4. The distance between the sliding door 4 and the running rail 3 is kept as small as possible, in order to avoid a disturbing air gap. Hence, access to the mounting devices 10A; 10B is only possible from one side. However, this access is advantageously provided with the inventive mounting devices 10A, 10B.

FIG. 1B shows a part of the sliding device 100 of FIG. 1A with the first mounting device 10A, which comprises a holding rail 6 arranged in a recess 40 provided at the upper side 41 of the sliding door 4 and a holding device 1 held in the holding rail 6. The holding device 1 is connected via a connecting bolt 5 to the body 22 of a carriage 2, which is guided with two track rollers 22 in a running rail 3.

FIG. 1B and FIG. 2A show, that the holding rail 6 is kept a distance away from the front side 42 of the sliding door 4, so that the entry port of the recess 40 can receive a mounting flange 16 provided at the holding device 1, which partially overlaps the front side of the holding rail 6. If the carriage 2 hits an obstacle within the running rail 3, e.g. an end stop or a buffer device, then the force exerted by the sliding door is transferred via the holding rail 6, the mounting flange 16 and further via the holding device 1, the connecting bolt 5 and the carriage 2 to the buffer device (not shown), which receives and absorbs the force and the connected energy of the sliding door 4.

In a below described preferred embodiment and elastic element, which can absorb the kinetic energy of the sliding door 4, is integrated into the holding device 1.

FIG. 2A shows the first mounting device 10A with the holding device 1, which is being inserted into what has been taken out of the holding rail 6.

In the detailed view D1 of FIG. 2C the end piece of the holding device 1 of FIG. 2A is shown (see arrow D1).

In the detailed view D2 of FIG. 2D the end piece of the holding rail 6 of FIG. 2A is shown (see arrow D2), which is fully received by the recess 40 of the sliding element 4 and fixed therein with mounting screws 65 that are located in mounting bores 66 provided in the centerpiece 62 the holding rail 6 (see FIG. 5A). It is further shown that the holding rail 6 comprises two fixing elements 63*a*, 63*b* in the centerpiece 62, which serves for receiving a holding element 113, with which the holding device 1 can be fixed at selected positions within the holding rail 6. The fixing elements 63*a*, 63*b* are bores or recesses embossed or worked into the holding rail 6.

In the shown embodiment, the holding device 1 comprises a two-part bearing device 11, 12 with a first bearing member 11 and a second bearing member 12, an adjustment screw 13, a track body 14 and the connecting bolt 5 that is held by a track sledge 15 (see FIG. 5A) and that comprises an upper connecting part 53, which has been turned into the body 21 of the carriage 2. By means of the connecting bolt 5 the holding device 1 can be connected in a simple manner to the carriage 2. By inserting the holding device 1 into the holding rail 6 the connection between the sliding element 4 and the carriage 2 is established.

FIG. 2*c* shows, that the holding device 1, at the end facing the front side 42 of the sliding element 4, is provided with a functional cover 19, which advantageously covers the mounting device 10A that has been inserted into the sliding door 4. By opening the functional cover 19 a mechanic gets access to the adjustment screw 13, as shown e.g. in FIG. 5A.

FIG. 8A shows that the functional cover 19 comprises two hinge bores 199, in which hinge pins 119 provided at the first bearing member 11 can engage. Hence, the functional cover 19 can be turned around the hinge pin 119 and opened.

FIG. 2C further shows that the first bearing member 11 comprises a holding arm 112, which is provided with the holding element 113. The front side of the holding element 113 is beveled, so that the guide arm 112 is automatically lifted when the holding device 1 is shifted into the holding rail 6 and the holding element 113 is guided across the front sided edge of the holding rail 6. Subsequently the elastic holding arm 112 is tensioned, so that it guides the holding element 113 automatically into the first fixing element 63*a* then it is reached. Hence, the holding device 1 can be fixed in the holding rail 6 with a simple catch procedure. For releasing the holding device 1 the holding arm 112 is lifted again, so that the holding element 113 can get released from the fixing element 63*a*. Hence, with the holding arm 112 being lifted the holding device 1 can further inserted into or removed out of the holding rail 6. It is further possible to use additionally or alternatively laterally and symmetrically arranged holding elements that can engage into related bores provided in the holding rail 6.

In a preferred embodiment the functional cover 19 serves for actuating the holding arm 112. For this purpose the functional cover 19 is provided with a functional lever 191, that engages with the guide arm 112 or a release lever 114 connected thereto (see FIG. 8A).

FIG. 2B shows a cut through the holding rail 6 in the range of the fixing element 63*a* along the cutting line A-A shown in FIG. 2A and FIG. 3B.

In this embodiment the holding rail 6 comprises a U-profile with a centerpiece 62 and sidewalls 61 connected thereto, which on the sides facing one another are provided with shaped elements 611, that extend in parallel to the longitudinal axis of the holding rail 6 and that exhibit a hook-shaped cross-section. The shaped elements 611 serve for holding the holding device 1 in a form-locking manner. The second bearing member 12 of the holding device 1 comprises a plate-shaped guide arm 122, which is provided on both sides each with a mounting shoulder 123. When inserting the holding device 1 into the holding rail 6, the mounting shoulders 123 are guided along the shaped elements 611, wherefore the holding device 1 is held in a form-locking manner and axially movable only.

FIG. 3A shows the holding device 1 of FIG. 2B from the front side. Shown are the first bearing member 11 with the holding arm 112 and the second bearing member 12 with the guide arm 122, which comprises the guide member 125 at the front end, within which the connecting bolt 5, which at the lower end is connected to a track sledge 15, is held vertically shiftable.

FIG. 3B shows the mounting device 10A of FIG. 2B with the holding device 1 inserted in the holding rail 6.

FIG. 3C shows a cut through the holding device 1 of FIG. 3A along cutting line B-B shown in FIG. 3A. The cut runs through the bearing device 11, 12 and shows that its bearing members 11, 12 enclose a screw channel 130, in which the adjustment screw 13 is rotatably supported and held.

The two bearing members 11, 12 comprise each a bearing body 111, 121 with tooth elements 116, 126, which are engaged into one another in a form-locking manner. The first bearing member 11 is further provided with catch elements 118, which engage in catch openings 129 provided in the second bearing member 12 and which are locked there in a catch seat 128.

Hence, the two bearing members 11, 12 are connected with one another in a form locking manner and can get released from one another only by releasing the catch elements 118.

The two bearing members 11, 12 can be produced more easily than a unitary bearing device. By selecting suitable materials, the functions of the two bearing members 11, 12 can advantageously be implemented. The first bearing member 11 is preferably made from plastic, so that an elastic holding arm 112 can be made, which is bendable for the purpose of releasing the holding element 113 and preferably also extendable for the purpose of absorbing the kinetic energy of the sliding door 4 when reaching the end stop, thus avoiding a high load on the device parts and disturbing sound.

FIG. 4 shows the holding device 1 of FIG. 3A with the first bearing member 11, which comprises a bearing channel 110, in which the adjustment screw 13 is seated. Further shown are the tooth elements 116 and the catch elements 118 that are connected in one piece with the bearing body 111 of the first bearing member 11. It is further shown that the functional cover 19 is coupled with the first bearing member 11. It is shown that the first bearing member 11 can be accessed through the mounting flange 16, as soon as the functional cover 19 is opened.

The second bearing member 12 is shown separately with the second bearing body 121, which comprises the tooth elements 126, the catch openings 129 and the guide arm 122 with the mounting shoulders 123 provided on both sides. At the front end the guide arm 122 is provided with the guide member 125, which has a guide opening 1250, through which the connecting bolt 5 can be inserted into the holding device 1.

The connecting bolt 5 comprises a first connecting part 51 that is insertable into the track sledge 15, a second connecting part 52 that is held vertically shiftable in the guide member 125 and a third connecting part 53 that is connectable to the carriage 2 and that preferably comprises a screw thread, which can be turned into the body 21 of the related carriage 2.

The track sledge 15, which is seated slidably within the track body 14, comprises a receiving opening 151 for receiving the first connecting part 51 of the connecting bolt 5 as well as wing-shaped or cuboidal first and second guide elements 152A, 152B on opposite sides.

The track body 14 comprises a threaded member 141 with a threaded bore, in which the screw shaft 132 of the adjustment screw 13 can engage. The track body 14 further comprises a first and a second track wall 143A; 143B, which on the sides facing one another are provided with first and second track elements 142B (142A is not shown). The track elements 142A, 142B, which are formed as guide grooves or track slots carved into the track walls 143A, 143B, are extending in parallel to one another and are inclined to the longitudinal axis of the adjustment screw 13 or the screw axis y, respectively.

The two track walls 143A, 143B enclose a track body channel 140, in which the track sledge 15 can be inserted in such a way, that its guide elements 152A, 152B engage in the rail-shaped track elements 142A, 142B. Hence, the track sledge 15 can be moved within the track body channel 140 inclined to the screw axis y from bottom to top.

FIG. 5A shows a cut through the mounting device 10 of FIG. 3B along the cutting line C-C. The bearing device 11, 12 is vertically copped along the screw axis y. Between the first bearing member 11 and the second bearing member 12, the head 131 and the screw shaft 132 of the adjustment screw 13 are held, which extends through the threaded member 141 into the track body 14. The head 131 of the adjustment screw 13 is held rotatable but axially immovable in a screw seat 127, which is formed within the second bearing member 12. The screw head 131 is further supported by a support body 117 that is provided on the first bearing member 11.

The bearing device 11, 12 is held in a form-locking manner by the shaped element 611, which is provided on the sidewall 61 of the holding rail 6 and which abuts the second bearing member 12 or second bearing body 121, respectively, and the guide arm 122.

The holding device 1 is axially movable within the holding rail 6 until the holding element 113 engages in the selected fixing element 63*a*, as shown in the detailed view D3 of FIG. 5B (see the arrow D3 in FIG. 5*a*). In this detailed view the end piece of the holding arm 112 is shown that faces the functional cover 19 and that is provided with the catch element 113 and a release lever 114, which can interact with the functional lever 191 provided on the functional cover 19.

The holding element 113 comprises a flank 630 that is inclined at the side facing the holding rail 6. When the holding device 1 is inserted into the holding rail 6 the flank 630 is guided over the upper front edge of the centerpiece 62 of the holding rail 6, whereby the holding arm 112 is lifted upwards. In this manner the holding device 1 can be shifted into the holding rail 6, without lifting the holding arm 112 with other means. Alternatively the centerpiece 62 of the holding rail 6 can be provided at the front side with an inclined plane, over which the holding element 113 can slide into the holding rail 6 and at the same time can lift the holding arm 112. In this case, a holding element 113 can be used that is fully adapted to the fixing element 63*a* and that is securely held by the fixing element 63*a*.

Detailed view D4 of FIG. 5C shows the track sledge 15 of FIG. 5A (see the arrow D4 in FIG. 5A), in which the first connecting part 51 of the connecting bolt 5 is held firmly or rotatable. The second connecting part 52 is held within the guide member 125 slidable along the guide axis x. Hence, the connecting bolt 5 is held in such a way that it can be shifted only along the guide axis x and thus perpendicularly to the screw axis y. Further shown is the track wall 143B with the groove-shaped track element 142B, in which the second guide element 152B of the track sledge 15 engages.

FIG. 6A shows in sectional view the track body 14 with the second track element 142B, which exhibits a rectangular cross-section and which completely traverses the second track wall 143B from bottom to top. Further shown is the track sledge, which is vertically shifted as soon as a horizontal movement of the track body 14 occurs.

FIG. 6B shows the complete track sledge 15 of FIG. 6A, which comprises a receiving opening 151 for the connecting bolt 5 and, on opposite sides, the two guide elements 152A, 152B. In this preferred embodiment the guide elements 152A, 152B are held in a form-locking manner within in the track elements 142A, 142B and only movable along the straight line.

FIG. 7A shows the mounting device 10 in the sectional view of FIG. 5A with the track sledge 15 and the connecting bolt 5 completely moved downwards.

FIG. 7B shows the mounting device 10 in the sectional view of FIG. 5A with the track sledge 15 and the connecting bolt 5 at intermediate height.

FIG. 7C shows the mounting device 10 in the sectional view of FIG. 5A with the track sledge 15 and the connecting bolt 5 completely moved upwards.

It is shown that the connecting bolt 5 has been moved axially only along the guide axis x, while the track body 14 has been moved axially only along the screw axis y.

FIG. 8A shows the first bearing member 11 of FIG. 4 from the rear side after the removal of the functional cover 19. It is shown, that the mounting flange 16 consists of two beam-shaped parts, which are provided at the lower end with hinge pins 119 that are directed towards one another and that can engage in openings 199 provided in the functional cover 19. The functional cover 19 held by the hinge pin 119 comprises the functional lever 191, and interact with the release lever 114, which is provided at the front of the holding arm 112.

FIG. 8B shows the first bearing member 11 of FIG. 8A in a further embodiment with a holding arm 112 that is bendable and extendable. The holding arm 112 is S-shaped and therefore extendable. At the same time the end piece of the holding arm 112 can be lifted upwards with the functional lever 191 in order to release the holding element 113 from the fixing element 63*a* or 63*b*.

With reference to FIG. 5C it has been mentioned, that the first connecting part 51 of the connecting bolt 5 is held preferably rotatable in the track sledge 15.

FIG. 9 shows the rear end of the holding device of FIG. 5A with the connecting bolt 5 in a preferred embodiment, which is provided with a tool coupling 54 between the first connecting part 51 and the third connecting part 53. The connecting bolt 5 can be grasped at the tool coupling 54 with a screw wrench T1 and turned as required.

At the lower end of the connecting bolt 5 A second tool coupling 55 is provided, into which a tool of a screw driver T2 can be inserted for turning the connecting bolt 5.

Hence, the holding device 1 can easily be coupled with a carriage that is already enclosed in a running rail, by turning the connecting bolt 5 manually or with the first or second tool T1, T2 into the carriage body. This adjustment of the connecting bolt is preferably performed, when the track sledge 15 is in the position shown in FIG. 7B or FIG. 9 at approximately at half height within the track body 14. After the installation of the holding device 1 of the track sledge 15 is positioned in the middle of the adjustment range, which can be driven through by the adjusting screw 13. In the event that the track sledge 15 gets later on to the edge of the adjustment range, then the track sledge 15 can easily be returned to the mid-range by actuating the first tool T1.

For connecting the connecting bolt 5 to the track sledge 15 the first connecting part 51 is provided with a ring groove 511, in which a plurality of holding seats 512 are provided. A bolt-like coupling element 7 has been inserted into the track sledge 15, which is provided with a spring channel 71 and a spring-loaded ball 72, which is pressed into an adjacent holding seat 512. When turning the connecting bolt 5, then the spring-loaded ball 72 is forced out of the holding seat 512, and can enter the next holding seat 512 e.g. after a half turn or a quarter turn of the connecting bolt 5. Hence, in this preferred embodiment the connecting bolt 5 can stepwise be turned from a first to a second position, varied is fixed again.

FIG. 10A shows a sectional view of the connecting bolt 5 and the track sledge 15 of FIG. 9 during installation. The fork-shaped track sledge 15 comprises a holding flange 155 having a U-profile, with legs extending in parallel and inclined to the screw axis y, thus forming an entry ramp 154. Hence, the first connecting part 51 of the connecting bolt 5 can be inserted inclined along the entry ramp 154 into the track sledge 15 and then be vertically aligned. The holding flange 155 then engages into the ring groove 511 provided in the first connecting element 51. Subsequently, the inclined entry ramp 154 prevents the connecting bolt 5 from getting released from the holding flange 155.

Hence, the fork-shaped embodiment of the track sledge 15 allows receiving a connecting bolt 5 that is designed as a single piece and holding the connecting bolt 5 rotatable in the ring groove 511.

It should be noted that several interacting device parts are interchangeable without changing the function of interaction. E.g., the connecting bolt 5 can also be provided with the holding flange and the track sledge 15 can be provided with the holding groove. As well the embodiments of the guide elements 152 of the track sledge 15 and the track elements 142 of the track body 14 can be interchanged.

FIG. 10B shows in sectional view the connecting bolt 5 and the fork-shaped track sledge 15 of FIG. 10A after the installation, after which the spring-loaded ball 72 of the coupling element 7 engages in a holding seat 512 in the connecting bolt 5, which thus is fixed.

FIG. 10C shows the connecting bolt 5 and the fork shaped track sledge 15 of FIG. 10B incomplete view.

LITERATURE

[1] EP0818598A1
[2] WO2011063535A1
[3] WO2011161707A1
[4] WO9738198A1
[5] DE3338146A1
[6] WO2004040091A1

LIST OF REFERENCES

1 holding device
10, 10A/B mounting devices
100 sliding device
11 first bearing member
110 first bearing channel
111 first bearing body
112 holding arm
113 holding element
114 release lever
116 tooth element
117 support body
118 catch elements
119 hinge pin
12 second bearing member
120 second bearing channel
121 second bearing body
122 guide arm
123 mounting shoulder
125 guide member
1250 guide opening
126 tooth element
127 screw seat
128 catch seat
129 catch opening
13 adjustment screw
130 screw channel
131 screw head
132 screw shaft
14 track body
140 track body channel
141 threaded member with a threaded bore
142 track elements, track slots
143 track walls
15 track sledge
151 receiving opening
152 guide elements, track runners
153 mounting opening
154 entry ramp
155 holding flange
16 mounting flange
19 functional cover
191 functional lever
199 hinge bores
2 carriage
21 carriage body
22 track rollers
3 running rail
4 sliding element, sliding door
40 recess in the upper side 41 of the sliding door 4
41 upper side of the sliding door 4
42 front side of the sliding door 4
43 lateral surface of the sliding door 4
5 connecting bolt
51 first connecting part
511 holding groove
512 holding seat
52 second connecting part
53 third connecting part
54 first tool coupling
55 second tool coupling
6 holding rail

60 receiving channel
61 sidewalls
611 shaped elements
62 centerpiece
63*a*, 63*b* fixing elements, bores or catch plane
630 inclined flank at the fixing element 63*a*
65 mounting bores
66 mounting screws
7 coupling element
71 spring channel
72 spring-loaded ball
9 tool channel
x screw axis
y guide axis
T1 first tool
T2 second tool

The invention claimed is:

1. A mounting device with a connecting bolt, with which a plate-shaped sliding element is connectable to a carriage that is held displaceable in a running rail, the mounting device comprising a holding rail, which is mountable in a recess provided at the upper side of the sliding element, and a holding device that is held releasably in the holding rail and that comprises a bearing device, in which an adjustment screw is rotatably held, which adjustment screw comprises a screw shaft that, aligned along its screw axis, engages in a threaded member of a track body, which is movable along the screw axis and which comprises two track walls that are aligned in parallel to one another and that comprise each a track element, in which guide elements are engaged that are connected to the connecting bolt, which is held in a guide member displaceable along a guide axis, wherein a track sledge is provided that is equipped on opposite sides with the guide elements that are engaged in the track element of the track body, wherein the connecting bolt comprises a first connecting part that is held in the track sledge, a second connecting part that is held in the guide member and a third connecting part that is connectable to the carriage, the third connecting part comprising a screw thread, which is configured to be turned into the body of the carriage, and wherein the first connecting part is held in a receiving opening of the track sledge, wherein the first connecting part is rotatable with respect to the track sledge about the guide axis after installation of the mounting device.

2. A mounting device according to claim 1, wherein the connecting bolt is made from one piece.

3. A mounting device according to claim 1, wherein in the track sledge a coupling element is held, which comprises a spring-loaded contact element, which engages in a holding seat that is provided in the first connecting part of the connecting bolt.

4. A mounting device according to claim 1, wherein the part of the connecting bolt which is extending out of the holding device or an end piece of the connecting bolt are provided with a tool profile capable of being grasped and turned with a tool.

5. A mounting device according to claim 1, wherein the connecting bolt comprises a holding groove and the track sledge comprises a holding flange or wherein the connecting bolt comprises a holding flange and the track sledge comprises a holding groove and wherein the holding groove and the holding flange are engaged in one another.

6. A mounting device according to claim 5, wherein the track sledge is fork-shaped and comprises the holding flange, which adjoins an entry opening.

7. A mounting device according to claim 6, wherein the holding flange forms a U-profile with legs that form extending parallel to one another and inclined to the screw axis and entry ramp, along which the first connecting element of the connecting bolt is insertable into the track sledge.

8. A mounting device according to claim 1, wherein the guide elements and the track elements comprises flat contact surfaces that are adjoining one another.

9. A mounting device according to claim 1, wherein the guide elements and the track elements engaged in one another, wherein the guide elements are guide ribs and the track elements are guide grooves or that the guide elements are guide grooves and the track elements are guide ribs.

10. A mounting device according to claim 1, wherein the bearing device comprises a holding arm with at least one holding element, which is coupleable in a form-locking manner with at least one fixing element that is provided on the holding rail, and wherein the holding arm is bendable in such a manner, that the holding element under impact of force onto the holding arm is decoupleable from the fixing element.

11. A mounting device according to claim 10, wherein the bearing device is pivotally connected to a functional cover, which covers a tool channel that provides access to the adjustment screw and which comprises a functional lever that is rotatable towards the holding arm, when the functional cover is opened, so that the holding arm under the impact of force is releasable from the holding rail.

12. A mounting device according to claim 10, wherein the bearing device consists of one piece or wherein the bearing device comprises a first bearing member with the holding arm and a second bearing member with the guide arm, and wherein the two bearing members comprise catch elements that are engaged in one another in a form-locking manner.

13. A mounting device according to claim 11, wherein a head of the adjustment screw is held rotatable but axially immovable in the bearing device and is facing the functional cover, which after opening provides access to the head of the adjustment screw.

14. A sliding door with two mounting devices according to claim 1, which are connected each on one side to a sliding element and on an other side to a carriage, which is guided with track rollers or sliding elements in a running rail.

* * * * *